US007000598B2

(12) United States Patent
Sheikh et al.

(10) Patent No.: US 7,000,598 B2
(45) Date of Patent: Feb. 21, 2006

(54) BUMPLESS CRANKSHIFT POSITION SENSING

(75) Inventors: Ahmed Esa Sheikh, Erie, PA (US); Suresh Baddam Reddy, Erie, PA (US); Bo Nilson Almstedt, Amal (SE); Andreas Peterson, Amal (SE)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 10/855,914

(22) Filed: May 27, 2004

(65) Prior Publication Data

US 2005/0263138 A1 Dec. 1, 2005

(51) Int. Cl.
*F02P 7/06* (2006.01)

(52) U.S. Cl. ..... 123/476; 123/406.58; 123/406.61; 123/480

(58) Field of Classification Search ..... 123/406.18, 123/406.58, 406.6, 406.61, 406.63, 406.65, 123/476, 480, 494
See application file for complete search history.

(56) References Cited

U.S. PATENT DOCUMENTS 4,941,445 A * 7/1990 Deutsch ..... 123/406.18
6,019,086 A 2/2000 Schneider et al.
6,684,687 B1 2/2004 Frojdh

* cited by examiner

*Primary Examiner*—Hai Huynh
(74) *Attorney, Agent, or Firm*—William Scott Andes; Timothy H. Van Dyke; Beusse Brownlee Wolter Mora & Maire, P.A.

(57) ABSTRACT

Disclosed herein are methods of generating an active crank series of signals that is derived from at least two series of signals, wherein one or both of the series of signals have been modulated to produce two series of signals that resemble each other. Also disclosed herein is a crankshaft positioning system for determining the rotational position of a crankshaft of an engine that utilizes at least two crank angle sensors 10 and 12. The signal information from the two crank angle sensors 10 and 12 is processed by a signal processor 150 such that the series of signals 220 from the second crank angle sensor 12 emulates the series of signals 210 from the first crank angle processor 10. The signal processor generates an active crank series of signals 230 based on the two series of signals 210, 220. The active crank series of signals 230 is sent to an engine control processor 120 which directs the injection and/or ignition of fuel into cylinders of an engine. According to the system exemplified herein, the active crank series of signals 230 sent to the engine control processor 120 is not disrupted despite failure of one of the crank angle sensors. These and other embodiments are disclosed.

27 Claims, 6 Drawing Sheets

BUMPLESS CRANKSHIFT POSITION SENSING

BACKGROUND OF THE INVENTION

In engines with electronic control unit (ECU), the primary information upon which engine control calculations are based is the engine crankshaft position. An electronic control unit comprises processors, software, and electronic hardware to process signals and perform engine operations. In most cases, crankshaft positioning relies on the respective cylinder top dead center position (TDC) as a reference point. This angle information is used to precisely time key events related to engine combustion, which in turn affects engine performance and emission. The accuracy of this information is critical, as any error may lead to engine control unit shutdown, thereby causing interruption in engine operation. There are generally two possibilities for signal failure: (1) failure of a sensor, wiring, or connector resulting in a loss of signal, or (2) a high level of external noise on the sensor signal lines that interferes with the calculation of the engine position.

In order to identify the cylinders of a multicylinder internal combustion engine, most ECUs require signals from a camshaft sensor and a crankshaft sensor. Most engines are configured such that the crankshaft undergoes two revolutions for every single revolution of the camshaft. Typically, the engine crankshaft comprises a crank wheel that is operationally coupled to the crankshaft. The crank wheel comprises a plurality of elements with at least one reference element, such as a missing gap, oversized element, an attached element or differently configured or shaped element, and the like. Crank sensors are positioned proximate to the crank wheel to produce signals upon passage of the elements. This signal information is sent to the ECU, and the ECU determines the position of the crankshaft by counting the number of elements after the marking element, this is also referred to as synchronization. This enables the ECU to know 360 degree position of the crankshaft. The ECU must then use the signal of the cam sensor to determine if the crankshaft is in the first position or the second position. Thus, if there is a break in the information from the crankshaft sensors, the ECU will lose the position of the crankshaft and will not know whether the crankshaft is in the first revolution or the second revolution. Consequently, the ECU cannot determine which cylinder should be injected with fuel or not (e.g. with respect to a typical diesel engine, whether the cylinder is in the power stroke or exhaust stroke). If a break in the crank sensor information occurs, the engine may be rendered incapacitated.

One attempt to minimize this problem has been to provide two crank sensors; the idea being that one crank sensor acts as a back-up sensor to the other. According to this configuration, the ECU will receive signal information from one of the sensors. If a failure happens, the ECU will effectuate a "switchover" to the other sensor. Having a redundant sensor does address the problem somewhat, but there remain important performance issues. In the event of a failure of one sensor, the ECU loses engine position and is incapable of calculating speed. The ECU must stop fueling and remove the load from the engine. Once switchover to the working sensor occurs, injection of fuel cannot be activated until crank position and crank revolution is determined. The synchronization of the crank sensor signals and determination of the proper crank revolution requires time. The cessation of fuel injection and removal of engine load during this time dramatically decreases engine performance.

DESCRIPTION OF PREFERRED EMBODIMENTS

Figure 1A:
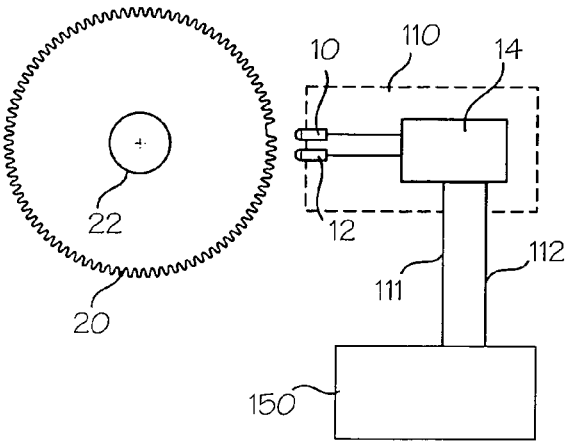
FIG. 1A represents a schematic diagram of a crankshaft positioning apparatus according to one embodiment of the subject invention.

In a basic embodiment, the subject invention pertains to a method of generating a continuous stream of signals derived from two separate signal streams from at least two separate crank positioning sensors. This continuous signal stream is inputted to an engine control processor which employs the signal information to direct various operations of the engine. One of the signal streams is altered by an ECU to resemble, or emulate, the other signal stream, resulting in two similar signal streams. Alternatively, both of the signal streams are altered to resemble a predefined signal stream that is different from either the first and second signal streams. The production of two similar signal streams serve as the basis for generating the continuous signal stream by which the crankshaft position can be continually monitored. Utilizing the two similar signal streams provides the advantage that if one or the other crank positioning sensors fails, the continuous signal persists. This overcomes the need to remove the load from the engine and reset the signal stream every time an intermittent or permanent failure of a crank positioning sensor occurs. Consequently, the performance of the engine is substantially increased.

Accordingly, one aspect of the subject invention pertains to a method of generating a continuous stream of signals derived from a series of signals from a first crank positioning sensor and a second crank positioning sensor. In typical situations, the method is utilized in conjunction with engines comprising a crankshaft operationally coupled to a rotating member, such as a crank wheel. On the circumference of the crank wheel are disposed a plurality of elements, such as ferromagnetic teeth, and at least one reference element. The first and second crank positioning sensors are mounted proximate to the rotating member to sense the passing of the elements. In a specific aspect, the first and second crank positioning sensors are offset from one another, one being down stream. The first crank positioning sensor produces a first series of signals and the second positioning sensor produces a second series of signals. The second series of signals is modulated to resemble the first series of signals, thereby producing two series of signals that resemble each other. So long as one or both of the series of signals is generated, a continuous active crank signal is maintained. This enables an ECU or similar device to continuously monitor crankshaft position and engine speed if even one of the crank positioning sensors fails. In turn, this alleviates performance problems caused by ceasing fuel injection and removing engine load.

In a more specific embodiment, the modulating step of the foregoing method comprises altering the second series of signals to create a reference element signal corresponding to a reference element signal from the first sensor; and/or creating an element signal corresponding to an element signal from said first sensor, in place of a reference element signal from said second sensor. In an alternative embodiment, both the first and second series of signals are modulated to resemble a predetermined, desired series of signals.

For the purposes of promoting an understanding of the principles of the invention, reference will now be made preferred embodiments illustrated in the drawings and specific language will be used to describe the same.

FIG. 1A shows a crank interface 110 and signal processor 150 receiving signals sent from the crank interface for use in conjuction with an internal combustion engine, in accordance with the principles of the subject invention. The crankshaft 22 drives a rotating member 20. The crankshaft 22 rotates twice per engine cycle for a four cycle engine. The apparatus 110 comprises a first crank positioning sensor 10 and a second crank positioning sensor 12 which are communicatingly connected to a converter 14, which converts analog signals to digital signals. The first and second crank positioning sensors 10, 12, and the converter 14 together comprise the crank interface 110. From the converter 14, digital signals from the first and second crank positioning sensors 10, 12 are sent to a signal processor 150 via lines 111 and 112, respectively. The rotating member 20 may be any conventional crank wheel or similar device comprising various elements. Shown in FIG. 1A, the rotating member 20 pertains to a crank wheel comprising a 90 minus 1 teeth elements 24 which produce a signal as each element passes by said first and second crank positioning sensors 10, 12. The signal processor 150 comprises electrical and software components to receive and process the output signals from the first crank positioning sensor 10 and the output signals from the second crank positioning sensor 12, such that the signals from the second crank positioning sensor 12 are modified to emulate the signals from the first crank positioning sensor 10. Employing the signals from either the first crank positioning sensor 10 or the second crank positioning sensor 12, the signal processor 150 produces an active crank series of signals, wherein the active crank series of signals persists despite operational failure of either the first crank positioning sensor 10 or second crank positioning sensor 12.

Figure 2:
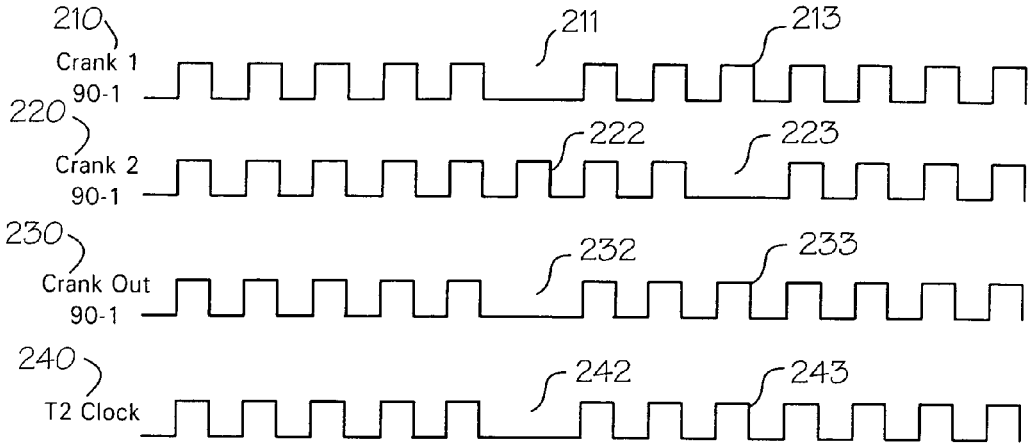
FIG. 2 shows a series of signals from sensors of an embodiment of the subject invention and the processed signal produced from such signals according to one embodiment of the subject invention.

FIG. 2 illustrates one embodiment of a unique method of modulating the signal information from the second crank positioning sensor which enables a bumpless (i.e., without loss of load) crank positioning sensing. The series of signals from a first crank positioning sensor 210 and the series of signals from a second crank positioning sensor 220 are employed to produce an active crank series of signals 230 and a clock series of signals 240. Each of the raised or "high" signals represents an element of a rotating member passing by the crank positioning sensor. The space between the high signals, or "low" signals represents the space between the elements. Wherever there is a missing element, there is a longer than normal low signal or "missing" signal (or sometimes referred to as gap signal). This missing signal acts as the reference signal for this embodiment. For example, 211 represents a missing signal from the series of signals of the first crank positioning sensor and 223 represents the missing signal from the series of signals of the second crank positioning sensor. The active crank signal 230 is the series of signals resulting from the combination of the first and second series of signals, wherein the series of signals from the second crank positioning sensor have been altered to emulate the series of signals from the first crank positioning sensor. High signal 222 has been blanked to emulate the gap signal 211 from the first crank positioning sensor, which registers as the missing signals 232 and 242 on the active crank signals 230 and clock signals 240, respectively. The gap signal 223 of the second crank positioning sensor has been altered to produce a high signal corresponding to 213 of the first crank positioning sensor, which is registered as high signal 233 and 243 of the active crank signals 230 and clock signals 240, respectively.

Figure 1B:
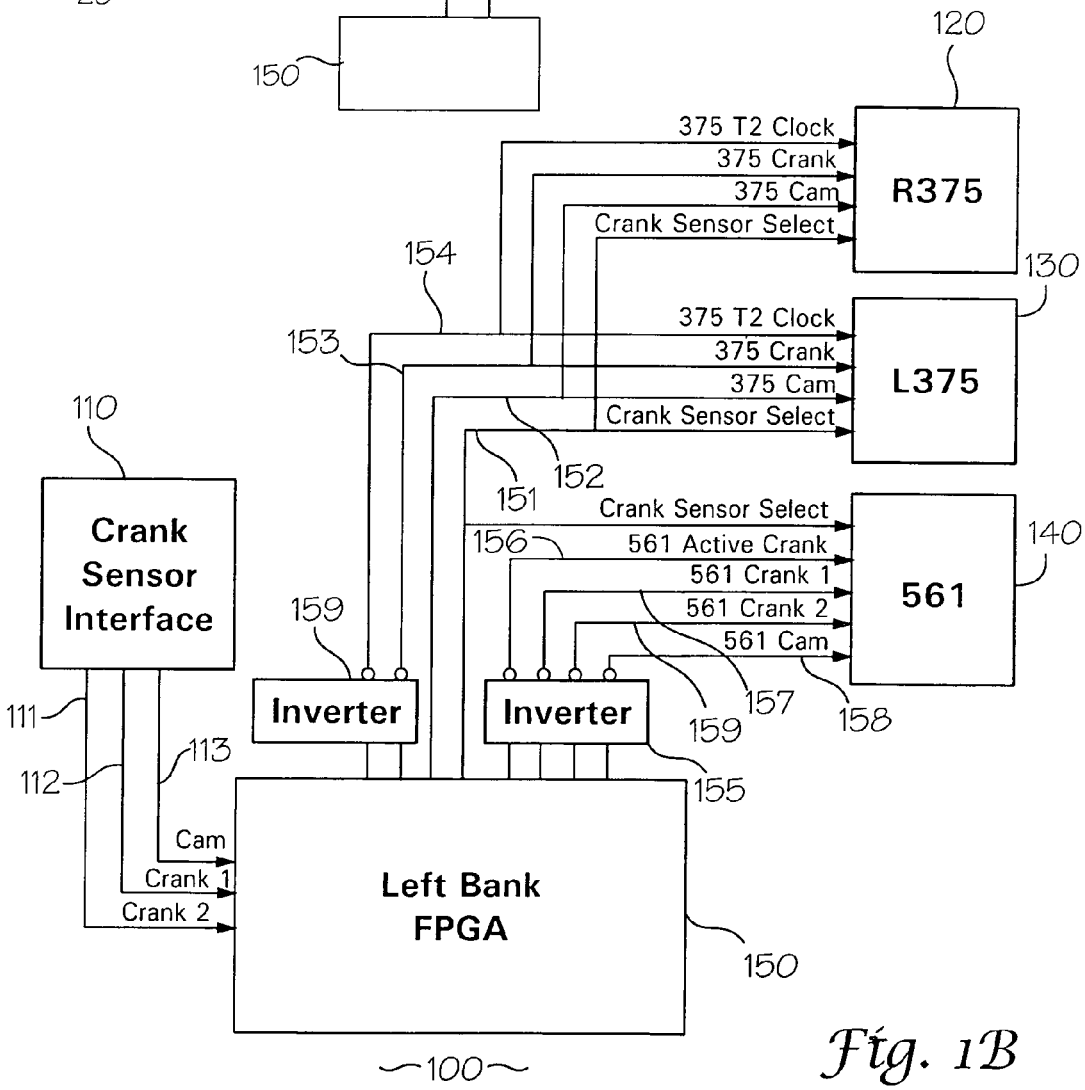
FIG. 1B represents a schematic diagram of an engine control system according to an embodiment of the subject invention.

The different embodiments illustrated in the figures show various aspects of how an engine control system may be configured and crank positioning signal streams may be modulated to determine crankshaft position, and ultimately control various engine routines. FIG. 1B shows a diagram of one embodiment of an engine control system 100 utilizing the crank interface 110 and signal processor 150 shown in FIG. 1A. By way of context, the system is utilized to determine the position of a crankshaft of a running internal combustion engine and control operations in said engine. The engine has cylinders defined therein, and pistons possessing rods which are operationally coupled to a crankshaft. Further, the rotating member is operationally coupled to the crankshaft such that the rotating member rotates two cycles per one engine cycle. First and second crank sensors are mounted in proximity to a crankshaft rotating member represented by the crank sensor interface 110. The first crank positioning sensor and second crank positioning sensor are connected via lines 111 and 112, respectively (also shown as Crank 1 and Crank 2), to a first processor 150 (also shown as Left Bank FPGA), see also FIG. 3. Generally, "lines" as used herein refers to wires or other conductive means for communicating electrical signals. In a typical embodiment, the rotating member comprises a wheel having a plurality of equidistantly spaced elements, with at least one element missing (gap). As the rotating member rotates, the equidistantly spaced elements and gap(s) pass by the first and second crank sensors thereby producing a continuous series of signals. The signal processor 150 processes the signals received from first and second crank positioning sensors such that the series of signals from the second crank positioning sensor emulate the series of signals from the first crank positioning sensor. The series of signals from the first and second crank positioning sensors are employed to form an active crank series of signals (also shown as 375 Crank). The engine control system may further comprise at least one engine control processor communicatingly connected to the signal processor. The engine control processor comprises programming (software) and/or circuitry to direct certain actions in the engine, such as, but not limited to, injection of fuel into cylinders and/or ignition of fuel. The engine control processor directs these actions based on the active crank series of signals and cam signals from the signal processor. Accordingly, the signal processor 150 sends the active crank series of signals to a first engine control processor 120 (also shown as R375) and a second engine control processor 130 (also shown as L375) via line 153.

Figure 3:
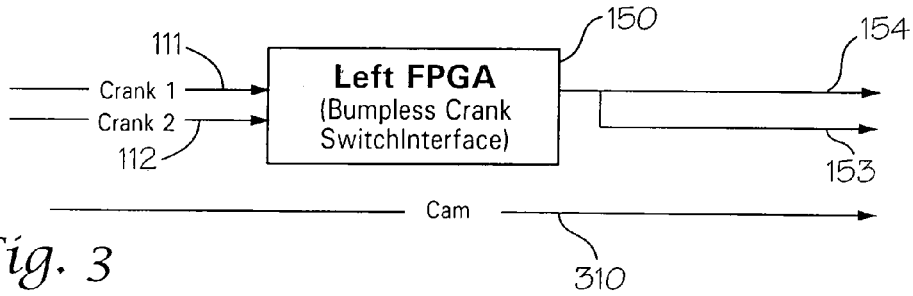
FIG. 3 shows a schematic diagram of a basic connection between a first and second sensor with a processor according to an embodiment of the subject invention.

In addition to the active crank series of signals, the signal processor 150 generates a clock series of signals, which is a duplicate of the active crank series of signals, as shown in FIG. 3. The origination of the clock series of signals and their function is described in more detail, infra. The clock series of signals is sent to the first and second engine control processors 120, 130 via line 154 (also shown as 375 T2 clock).

The signal processor also receives cam signals from a camshaft sensor (not shown) via line 113 (also shown as CAM). The cam series of signals is sent to the first and second engine control processors 120, 130 via line 152 (also shown as 375 cam).

FIG. 11B also shows a master processor 140. The master processor is not critical to operation of the crankshaft position sensing system 100 but may be employed to conduct various analyses of the system 100. The master processor 140 receives the signals from the first and second crank positioning sensors via lines 157 and 159, respectively (also shown as 561 crank 1 and 561 crank 2), without being processed. The master processor 140 also receives cam signals via line 158 (also shown as 561 cam), as well as the active crank signal series via line 156 (also shown as 561 active crank). The first engine control processor, the second engine control processor, and the master processor all receive a crank status signal via line 151 (also shown as Crank sensor select).

The first and second engine control processors 120, 130 are responsible for the operation of a bank of cylinders each (typically 6 or 8 cylinders based on 12 or 16 cylinder engines, respectively). Accordingly, in a 16 cylinder engine, the typical arrangement would comprise a left and right signal processor which are each in communication with two engine control processors, which each control a bank of 8 cylinders.

The system 100 also comprises external signal inverters 159 and 155 (also shown as INV. and Inverter). During processing, the signal processor 150 inverts the active crank signals and the clock signals. The external signal inverter 159 inverts these signals. The inverter also provides a robust (+5V) push pull signals that are more resilient to interference.

Figure 6:
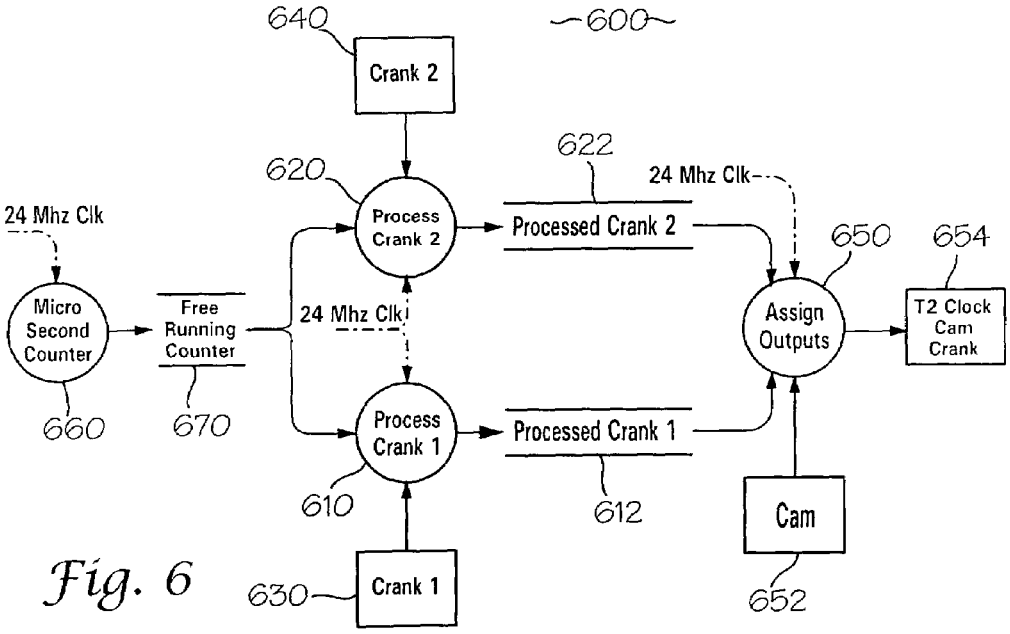
FIG. 6 is a diagram showing one arrangement for the electrical components of a processor to produce the processed signal from a first and second sensor.

FIG. 6 illustrates one example of the components and the programming of the signal processor 600 responsible for processing the series of signals from the crank positioning sensors. The signal processor 600 comprises a counter 670, a first processing module 610, a second processing module 620, and assignment/output circuitry 650. As described above, the first and second crank positioning sensors produce high signals corresponding to an element passing by the sensor, low signals corresponding to the space between the elements, and a missing signal corresponding to a missing element. The counter acts as a timer which the processing modules 610, 620 use to determine the time period for the high and/or low signals. The first processing module 610 processes information from a first crank positioning sensor. The second processing module 620 processes information from a second crank positioning sensor. The first and second processing modules 610, 620 ensure that the signal is synchronized, i.e., the proper number element signals before gap signal are accounted for which correlate with the number of elements of the rotating member. Those skilled in the art, in view of the teachings herein, will appreciate that the processing module may be any appropriate software and/or electronic circuitry configured to carry out the intended function. For example, the signal processor may comprise a storage medium (disc, chip, etc.) with program modules stored thereon, said program modules comprising computer readable code for processing the signals. Furthermore, electrical circuitry, such as an analog circuit, may be configured to process the signals in accordance with the intended function.

With respect to the second processing module 620, it is configured to create a missing signal and create a high signal corresponding to the signals of the first crank positioning sensor. Based on the predetermined spacing of the first and second crank positioning sensors, the second processing module 620 is configured to know where in the second series of signals the first crank positioning sensor is detecting a missing signal. For example, utilizing a 90–1 crank wheel as the rotating member, and spacing the crank positioning sensors at 12 degrees apart (i.e. three elements), the second processing module is configured to create a low signal when the second series of signals registers the $86^{th}$ high signal (see FIG. 9). In the alternate case of a 60–2 crank wheel, where the first and second crank positioning sensors are 12 degrees apart (i.e. two elements), the processing module creates a low signal on the $56^{th}$ signal. Conversely, the second processing module 620 is configured to generate a high signal at that point in time when the processing module has counted eighty-eight signals and is put in place of its normal missing signal (see FIG. 8). In the alternate case of a 60–2 crank wheel, where the first and second crank positioning sensors are 12 degrees apart, the processing module creates a high signal $57^{th}$ signal has been counted. The specific logic conditions by which the emulated missing signal and emulated high signal are created is described below in relationship to the particular states in which this occurs.

Figure 4:
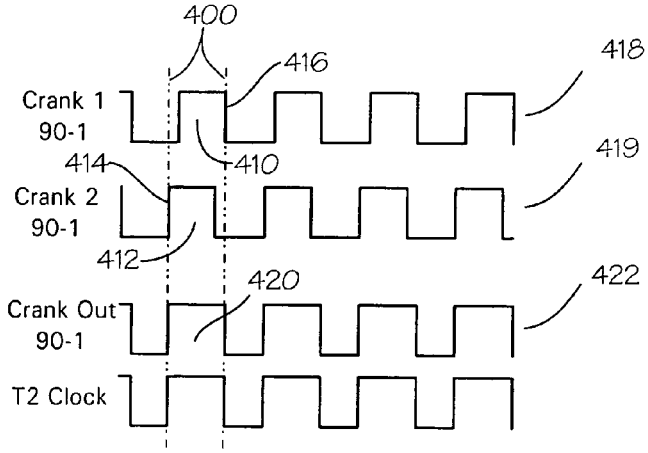
FIG. 4 shows signal pulses to depict the alignment of the series of signals from a first and second sensor according to an embodiment of the subject invention.

The signal processor 600 generates an active crank positioning series of signals based on the processed first crank positioning sensor signal series 612 and processed second crank positioning sensor signal series 622. This active crank positioning signal series stays constant even in the event of failure of the first or second crank positioning sensors. As shown in FIG. 4, the first and second series of processed signals 418 and 419, respectively, may by slightly askew as shown by dashed lines 400. If both series of signals are inputted, the output assignment processing module is configured such that the first rising edge 414 and the last rising edge 416 are used to produce the square wave signaling 420 of the active crank series of signals 422. If one or the other signals drops out, due, for instance, to some operational failure, the active crank series of signals 422 will resemble the remaining series of signals.

Figure 7:
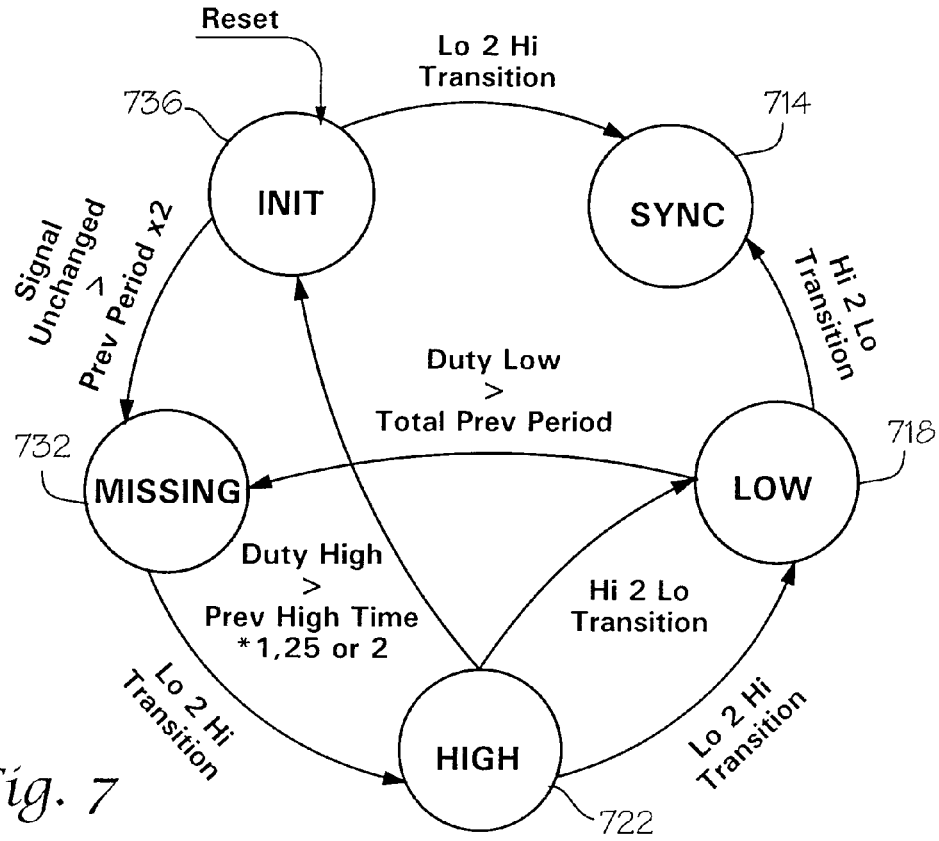
FIG. 7 is a diagram showing the process logic for processing signals from a first and/or second sensor.
Figure 12:
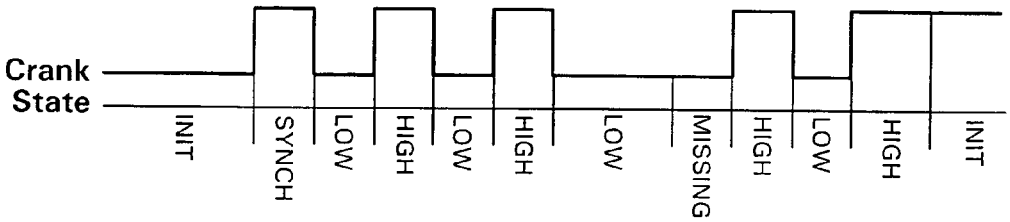
FIG. 12 is a simple diagram showing a sample of the timing steps of the flow diagram provided in FIG. 7.

As described generally above, the processing of crank positioning sensor signals is implemented by two separate processing modules 610, 620. FIG. 7 is directed to a flow diagram which shows the processing logic for one of the processing modules. The details of the processing will be described below. The process has five states: INIT 736, SYNC 714, LOW 718, HIGH 722, & MISSING 732. At engine start-up, the process starts at the INIT state 736, goes to the SYNC state 714 and proceeds to the states of LOW-HIGH-LOW-HIGH-LOW - - - LOW-MISSING-HIGH-LOW-HIGH-LOW etc., as shown in FIG. 12. Once the series of signals has gone through the various states, and the processing module has counted the predefined number of elements, the signal is considered synchronized. Upon synchronization of the series of signals, the signal processor 600 initiates the modifying process of the series of signals from the second crank positioning sensor. If after synchronization, one of the signals disappears (too long MISSING state 732) or if the length of the HIGH state 722 is too long, the process goes back to the INIT-state 736 to begin synchronization again. It must be noted that the second processing module 620 comprises the same functioning and programming of the first processing module 610, with the second processing module comprising additional programming to modulate the second series of signals to resemble the first series of signals, i.e., generate low signal corresponding to the missing signal from the first series of signals and generating high signal corresponding to the missing signal of the second series of signals. Described below is a more detailed description of each of the states, and the additional functioning of the second processing module 620 is indicated where appropriate:

A. INIT State. The INIT state 736 is entered from the MISSING state 732 if the crank input signal has been low for a time equal or greater to twice the last measured period time, or if HIGH signal has been high for 25% (normal) or 100% (first after missing) longer than previous high time. It is also entered as a result of reset pin pulled low by the processor. In the INIT state 736, all counters, error flags and timers are set to their default values. Crank output is set to 0. As a result of a low to high transition on the crank input signal the following actions are taken: (i) timestamp for high time start is saved; and (ii) SYNCH state is entered.

B. SYNC State. The SYNC state 714 is entered from the INIT state 736 as a result of a low to high transition on the crank input signal. The term "SYNC state" should not be confused with synchronization which occurs upon the processing module counting the predefined number of elements after the missing signal. In the SYNC state, a flag indicating whether or not the signal is synchronized is set to false and the crank output is set to 0. Upon synchronization, crank output is set to 1, meaning the processed signal is transmitted out of the processing module. Synchronization occurs when the processing module has counted 88 teeth after missing. The first tooth is counted as zero. This occurs during the MISSING state as described below.

As a result of a high to low transition on the crank input signal the following actions are taken: (i) timestamp for low time start is saved; (ii) high time is calculated as a result of low time start subtracted with time stamp for high duty start; and (iii) LOW state 718 is entered.

C. LOW State. The LOW state 718 is entered from SYNC state 714 or HIGH state 722 as a result of a high to low transition on the crank input signal. During the LOW state the missing element detection is performed and production of emulated high signal is created. The missing detection is done according to the fulfillment of the following condition:

Current time−Low time start>Previous Period Time

A period is the amount of time between High times. In case of second processing module, an additional element is created during the LOW state. An additional tooth is created on the crank output if the number of counted elements equals the last element before missing (the $88^{th}$ tooth for a 90−1 crank wheel), signal has been synchronized and the following condition is fulfilled:

Current time−Low time start>=Previous Low Time.

The additional element is set until the following condition is fulfilled:

Current time−Low time start>=Previous Period Time

Figure 8:
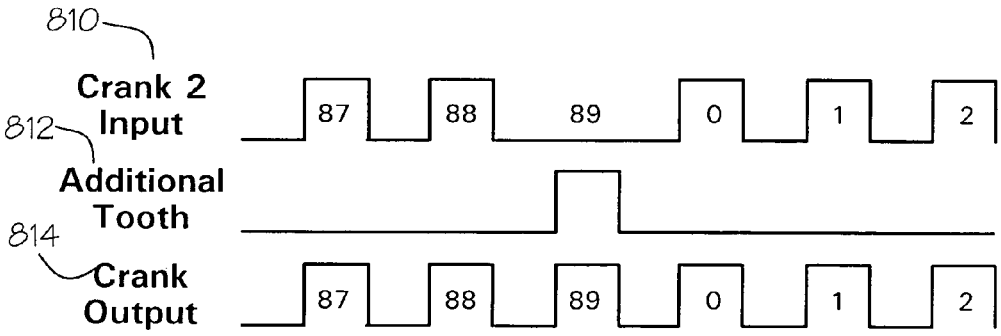
FIG. 8 shows the processing of a series of signals from a second sensor to emulate the signals of a first sensor so that a signal is created in place of a blank signal.

As shown in FIG. 8, the input from the second sensor 810 and representative additional element 812 is shown. The process generates a crank output 814 with an additional element 89. If signal is not synchronized and for crank 1 process the crank output is set to 0.

An exit from the LOW state 718 is performed due to one of the two following conditions:

(i) As a result of a low to high transition on the crank input signal where the following actions are taken:

Timestamp for high time start is saved.

Low time is calculated as a result of high time starts subtracted with time stamp for low time start.

Increment tooth counter with "1 tooth".

(ii) As a result of a missing tooth detected on the crank input signal where the following actions are taken:

Period is calculated as a result of current timestamp subtracted with time stamp for low time start.

Low time is calculated as a result of period time divided by two.

Timestamp for low time start is saved.

D. HIGH State. The HIGH State 722 is entered from the MISSING state 732 or LOW state 718 as a result of a low to high transition on the crank input signal. The emulated gap signal is produced during the HIGH state 722. The crank signal is monitored to detect a "stuck high" behavior that means it has been tied to a logic high level due to sensor lost when input equals 1. If the following condition is fulfilled the crank signal is considered to be "stuck high":

Current Time−High time start>Previous high time+25% (100% for first tooth after missing)

In case the crank signal is "stuck high" the Crank output is set to 0 preventing a disturbance in generating the T2Clock and Crank 90−1 signals.

Figure 9:
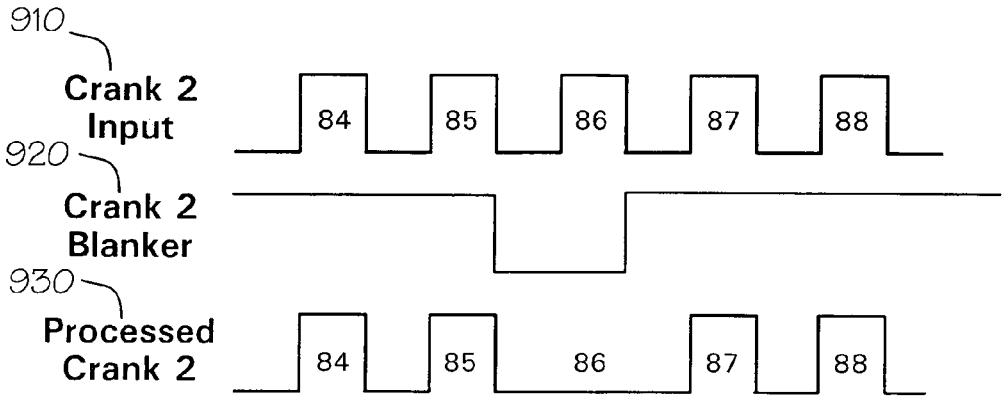
FIG. 9 shows the processing of a series of signals from a second sensor to emulate the signals of a first sensor so that a blank signal is created in place of a non-blank signal.

In the case of second processing module, an emulated low signal is generated relating to a missing signal corresponding to the missing signal in the processed first series of signals. With respect to the processing of signals from the second crank positioning sensor, the crank output is set to 0 (thereby generating a low signal) if the number of elements counted is equal to the position of crank 1 missing element and the signal has been successfully synchronized. The element number on which this occurs is declared in the signal processor and can not be changed. In the example of the rotating member comprising a 90−1 crank wheel, the element number will be 86 if the crank positioning sensors a spaced at 12 degrees. This will create an output as shown in FIG. 9. FIG. 9 shows the input from the second crank positioning sensor 910, the virtual missing or gap signal 920, and the resulting processed signal 930.

An exit from the HIGH state 722 is performed due to one of the two following conditions:

(i) As a result of a high to low transition on the crank input signal, where the following actions are taken:

Period is calculated as a result of current timestamp subtracted with time stamp for low time start.

Timestamp for low time start is saved.

High time is calculated as a result of low time starts subtracted with time stamp for high time start.

LOW state is entered.

(ii) As a result of a "stuck high" signal detected on the crank input signal where the following actions are taken:

Period is calculated as a result of current timestamp subtracted with time stamp for low time start.

Timestamp for low time start is saved.

High time is calculated as a result of low time starts subtracted with time stamp for high time start.

INIT state is entered.

E. MISSING State. The MISSING state 732 is entered from the LOW state 718 as a result of a missing tooth detected. In this state counters, timers and error flags are set/cleared for a new crank revolution. The tooth counter registers must be checked against the expected number of teeth to be able to determine whether or not the signal can be considered synchronized. In a specific embodiment where the rotating member comprises a timing wheel comprising 90–1 teeth, the synchronized flag is set if counted number of teeth equals the expected number of teeth. In the 90–1 case, the expected number of teeth would be 88, since first tooth after missing is said to be tooth 0.

An exit from the MISSING state 732 is performed due to one of the two following conditions:

(i) No rising transition detected for a time equal to two period times:

INIT state 736 is entered.

(ii) As a result of a low to high transition on the crank input signal where the following actions are taken:

Timestamp for high time start is saved.

Low time is calculated as a result of high time starts subtracted with time stamp for low time start.

Tooth counter is set to 0.

HIGH state 722 is entered.

After the series of signals from the first and second crank positioning sensors are processed, they are aligned utilizing logical OR circuitry and programming in the signal processor 150 to generate the active crank signal 230. FIG. 4 shows that the alignment of the signals 410 utilizes the first rising edge of a signal, in this case signal 412 of the second series 220, and the last falling edge of a signal, in this case signal 410 of the first series 210, to generate one signal 420. The active crank signal series output from the signal processor is 1 if both or one of the processed first series of signals and processed second series of signals is produced. The active crank signal series output will be 0 if both are not produced.

At each rising edge of the system clock the lock signal series, the active crank signal series and cam signal series outputs are updated with the latest values. The assignment/output circuitry 650 of signal processor 150 is configured to output signals according to the values provided in Table 1 (NOT notation used due to inversion that occurs post signal processor 150).

TABLE 1

| | |
|---|---|
| Clock signal 154 | = NOT [(Processed Crank1) OR (Processed Crank2)] |
| Diag Active Crank 156 | = NOT [(Processed Crank1) OR (Processed Crank2)] |
| Active Crank 154 | = NOT (Processed Crank1) OR (Processed Crank2) |
| 561 Crank1 | = NOT Crank1 |

TABLE 1-continued

| | |
|---|---|
| 561 Crank2 | = NOT Crank2 |
| 561 Cam | = NOT CAM |
| 375 Cam | = CAM |
| Crank Sensor Select | = 0 if both Crank1 Processed Signal and Crank2 Processed Signal OK<br>= 1 if error flag set in either Crank1 Process or Crank 2 process, due to<br>missing signal (low state too long)<br>high state too long<br>wrong number of teeth between missing |

Figure 10:
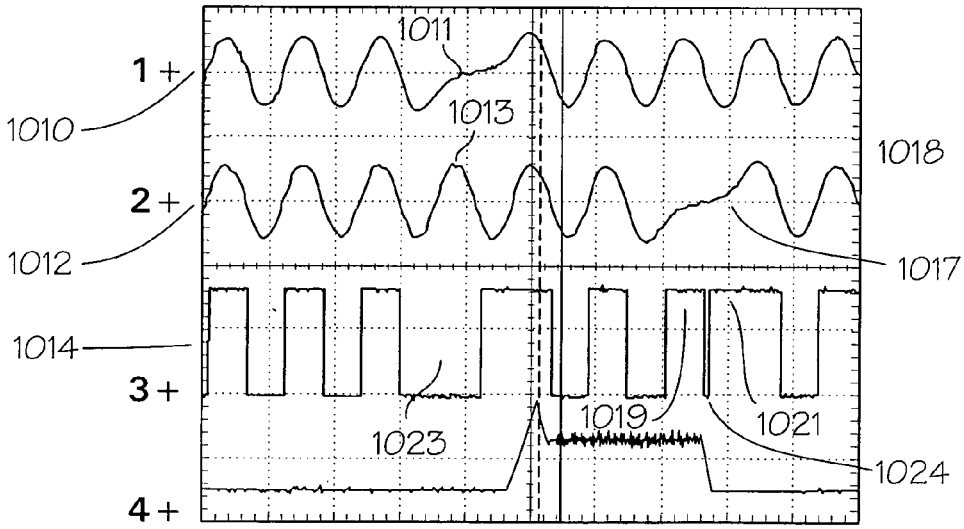
FIG. 10 is a picture of a monitor graphing the analog signals from a first sensor and a second sensor, and a processed signal.
Figure 11:
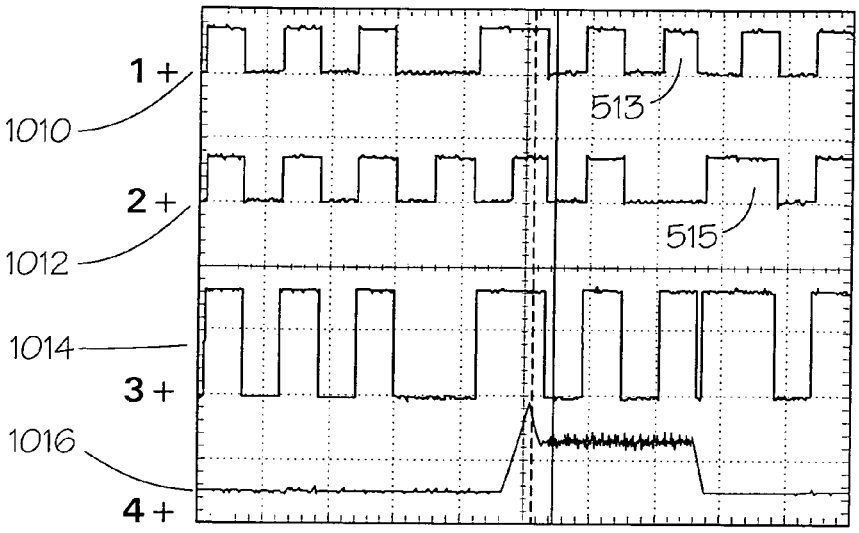
FIG. 11 is a picture of a monitor graphing the digitized signal versions of the series of signals from the first and second sensors shown in FIG. 10, as well as the processed signal.

FIG. 10 is a picture of a oscilloscope monitor which shows the analog signals of first crank positioning sensor 1010, analog signals of a second crank positioning sensor 1012, and an active crank signal 1014 generated from the processed signals from a first and/or second crank positioning sensor as described above. The missing element (or gap signal) as sensed from the first crank positioning sensor is shown at 1011. Even though the corresponding signal from the second sensor shows an element signal 1013, the active crank signal 1014 registers a missing element 1023 signal corresponding to the missing element 1011 signal from the first sensor. In addition, the gap signal from the second crank positioning sensor 1017 registers as an element signal 1019 on the active crank signal series, which corresponds to the element signal 1018 from the first crank positioning sensor. FIG. 10 shows the broadening (or shifting to left) of the third element 1021, which is caused by the gap signal 1017. As a result, the low signal 1024 between the second and third elements is much narrower than the other low signals. FIG. 11 represents a picture of an oscilloscope monitor that shows digitized versions 1110 and 1112 of the analog signals from the first and second 101 and 1012, respectively.

Figure 5:
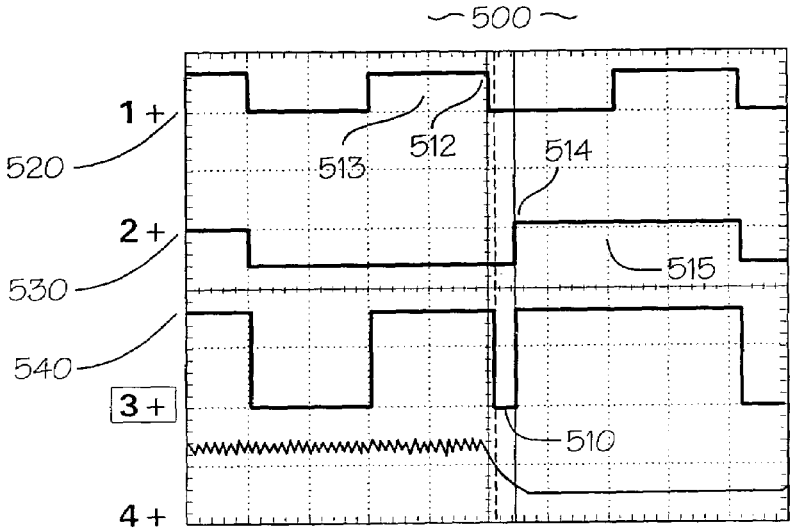
FIG. 5 is a picture of a monitoring showing the signals of a first and second sensor corresponding to the signals depicted in FIG. 4.

FIG. 5 shows a close up of the digitized versions of the first crank positioning signal series 1110, the second crank positioning signal series 1112, and the active crank signal series 1014, surrounding the gap signal in the second crank positioning signal series 1112 shown in FIG. 10. FIG. 5 shows the basis for the narrow low signal 510 between the second and third elements after missing. The narrow low signal is the difference between the falling edge 512 of the second element 513 from the first crank positioning signal series and the rising edge 514 of the zero element (immediately after missing) 515 of the second crank positioning signal series. FIG. 5 demonstrates that one skilled in the art must carefully determine the spacing between the first and second crank positioning sensors. Those skilled in the art will appreciate that the second crank positioning sensor can be spaced downstream of the first crank positioning sensor so long as there is enough of low signal generated between the rising edge of the first element after missing for the second crank positioning signal series and the falling edge of the preceding element in the first crank positioning signal series. Even though the low signal is abridged, the falling edge position is still correct, and since all positioning of injection pulses are made on the falling edge, the skewed low signal has no impact on injections. However, if the crank positioning sensors are mounted too close to each other, the low signal would be lost, causing the injection timing to fall out of sync.

Referring back to FIG. 1A, preferably, the second crank positioning sensor 12 is positioned such that it is twelve degrees (i.e. three high signals) downstream from the first crank positioning sensor 10. This distance can be higher or lower so long as the low signal 1017 discussed in reference to FIG. 10 is produced. The positioning of the crank positioning sensors will also be dictated by the spacing and/or mounting constraints around the crank shaft, rotating member, and/or crankcase of the engine. Table 2 shows various low times measured at five different running speeds where the second crank positioning sensor 12 is spaced twelve degrees downstream of the first crank positioning sensor 10:

TABLE 2

| | |
|---|---|
| 50 rpm: | low time = 0.54° |
| 100 rpm | low time = 0.36° |
| 330 rpm: | low time = 0.28° |
| 400 rpm: | low time = 0.36° |
| 1000 rpm: | low time = 0.79° |

In additional embodiment, an improved condition is set for the HIGH state in the second processing module (620 described in reference to FIG. 6 above) to decrease high time corresponding to the zero element (515 of FIGS. 5 and 11) in the second series of signals:

If (element counter=zero element) and ((Current Time−High Start Time)<(Previous Period Time/4)) then Processed second crank series signal output='0'.

This, in turn, increases the low signal 1024. With this improvement, width in 1024 will increase to a range of between 1.28 & 1.79 degrees from the range of between 0.28 & 0.79 shown above in Table 1. This will increase the phase margin capability between these crank signals.

According to another embodiment, the subject invention pertains to a computer program product for use with a locomotive engine, said product comprising: a computer-usable medium comprising computer readable program code modules embodied in said computer-usable medium for manipulating signals from a first and second crank positioning sensors, said first and second crank positioning sensors generating a series of digital high signals, a series of digital low signals and at least one reference signal; computer readable first program code module for causing a computer to count the number of high signals occurring between two successive reference signals; computer-readable second program code module for causing said computer to convert at least one high signal from said first or second crank positioning sensors into a reference signal at a predetermined location on said series of high signals; and computer-readable third program code module for causing said computer to create at least one high signal in place of said at least one reference signal from said first or second crank positioning sensors. The computer-readable medium may be any suitable medium for embodying computer program modules, including, but not limited to, computer floppy discs, compact discs, portable storage units, processors, memory units, hard-drives, and any other medium known to those skilled in the art to embody a program module.

The teachings of the references cited in the specification are incorporated herein in their entirety by this reference to the extent they are not inconsistent with the teachings herein. While various embodiments of the present invention have been shown and described herein, it will be obvious that such embodiments are provided by way of example only. Numerous variations, changes and substitutions may be made without departing from the invention herein. Accordingly, it is intended that the invention be limited only by the spirit and scope of the appended claims. For example, those skilled in the art will recognize that, in addition to conventional 90−1 and 60−2 crank wheels, any number of rotating member apparatuses may implemented comprising a plurality of elements that generate a signal stream. Furthermore, though crank wheels comprising a missing element or elements are exemplified herein as the reference element, many different elements may be implemented such as, but not limited to, a wider element or different shaped element. In addition to magnetic sensors, variable reluctance sensors and hall sensors, any number of other sensors that are capable of sensing the passage of elements of the rotating member may be implemented in accord with the teachings herein. The methods, systems and apparatuses described herein may be employed to determine crankshaft position of internal combustion engines directing crankshaft rotation, including, but not limited to, internal combustion engines powered by diesel fuel, gasoline, and the like. The embodiments may be adapted for many engine configurations including, but not limited to, straight 4, 6, 8, 12, and 16 cylinder engines and V4, V6, V8, and V16 engines.

What is claimed is:

1. For use with an internal combustion engine comprising a crankshaft and a rotating member operationally coupled thereto, a method of generating a continuous stream of signals useful for determining crankshaft position, said continuous stream of signals derived from a first series of signals from a first crank positioning sensor and a second series of signals from a second crank positioning sensor, said method comprising:

modulating said second series of signals to produce a modulated series of signals that resembles said first series of signals, thereby producing two series of signals that resemble each other; and generating a signal stream based on (i) a combination of said first series of signals and said modulated series of signals if both of said first and second crank positioning sensors are operating, (ii) said first series of signals if said first crank positioning sensor is operating and said second crank positioning sensor is not operating, and (iii) said modulated series of signals if said second crank positioning sensor is operating and said first crank positioning sensor is not operating wherein said modulated series of signals resembles said first series of signals such that a continuous stream of signals is generated that persists in the event of operational failure of one of said first and second crank positioning sensors without needing to switchover from said first series of signals to said modulated series of signals, or vice versa.

2. The method of claim 1, wherein said rotating member comprises a plurality of elements thereon with at least one reference element, and modulating said second series of signals comprises altering said second series of signals to create a reference element signal corresponding to a reference element signal from said first crank positioning sensor.

3. The method of claim 1, wherein said rotating member comprises a plurality of elements thereon with at least one reference element, and modulating said second series of signals comprises altering said second series of signals to create an element signal in place of a reference element signal on said second series of signals.

4. The method of claim 1, wherein said rotating member comprises a plurality of elements thereon with at least one reference element, and modulating said second series of signals comprises altering said second series of signals to create a reference element signal corresponding to a reference element signal from said first crank positioning sensor, and altering said second series of signals to create an element signal in place of a reference element signal on said second series of signals.

5. The method of claim 1, wherein said rotating member is a crank wheel operationally coupled to said crankshaft, said crank wheel comprising a plurality of equidistantly spaced elements, and said first and second crank positioning sensors are offset twelve degrees apart.

6. The method of claim 5, wherein said crank wheel comprises 90 minus 1 teeth and said modulating said second series of signals comprises creating a reference element signal in place of an element signal corresponding to the tooth 86 signal in said second series of signals, and creating an element signal corresponding to the reference tooth signal in said second series of signals.

7. The method of claim 5, wherein said crank wheel comprises 60 minus 2 teeth and said modulating said second series of signals comprises creating a element signal in place of an element signal corresponding to the tooth 56 signal in said second series of signals, and creating an element signal corresponding to the tooth signal in said second series of signals.

8. The method of claim 1, wherein said continuous crank signal is employed to direct injection of fuel in a cylinder defined in said engine.

9. The method of claim 1 wherein said modulating said second series of signals comprises altering said second series of signals to create a reference signal corresponding to a reference signal from said first sensor; and, in place of a reference signal from said second sensor, creating an element signal corresponding to an element signal from said first sensor.

10. The method of claim 1, wherein said rotating member comprises is a crank wheel comprising 90 teeth minus 1.

11. The method of claim 1, wherein said second sensor is positioned 12 degrees downstream of said first sensor.

12. For use with an internal combustion engine comprising a crankshaft and a rotating member operationally coupled thereto, a method of generating a continuous stream of signals useful for determining crankshaft position, said continuous stream of signals derived from a first series of signals from a first crank positioning sensor and a second series of signals from a second crank positioning sensor, said method comprising:

modulating at least one of said first and second series of signals to produce at least one modulated series of signals, wherein modulating comprises one selected from the group consisting of (i) modulating said first series of signals to resemble said second series of signals, (ii) modulating said second series of signals to resemble said first series of signals, and (iii) modulating said first and second series of signals to resemble a predetermined series of signals, thereby producing two series of signals that resemble each other; and generating a stream of signals based on at least one series of resembling signals produced from (i), (ii), or (iii) that is continuous, despite operational failure of one of said first and second crank positioning sensors, without needing to switchover from one signal stream to another.

13. A method of determining crankshaft position of a running internal combustion engine comprising (a) providing a rotating member operationally coupled to said crankshaft such that the rotating member rotates two cycles per one engine cycle, said rotating member comprising a circumference which comprises a plurality of equidistantly spaced elements disposed thereon with at least one reference element;

(b) positioning a first sensor proximate to said rotating member such that said first sensor produces a first series of signals corresponding to said plurality of equidistantly spaced elements and at least one reference element passing by said first sensor;

(c) positioning a second sensor proximate to said rotating member such that said second sensor produces a second series of signals corresponding to said plurality of equidistantly spaced elements and said at least one reference element passing by said second sensor, wherein said second sensor is placed at a predetermined distance downstream of said first sensor with respect to the rotational direction of said rotating member;

(d) modulating said second series of signals such that said second series of signals resembles said first series of signals thereby producing a modulated series of signals;

and (e) generating a continuous stream of signals useful for determining crankshaft position, wherein said continuous stream of signals is based on (i) a combination of said first series of signals and said modulated series of signals if both of said first and second crank positioning sensors are operating, (ii) said first series of signals if said first crank positioning sensor is operating and said second crank positioning sensor is not operating, and (iii) said modulated series of signals if said second crank positioning sensor is operating and said first crank positioning sensor is not operating wherein continuous stream of signals is maintained, irrespective of a failure of either said first sensor or said second sensor, without needing to switchover from said first series of signals to said modulated series of signals, or vice versa.

14. A signal processor configured to receive respective signals from a first and second crank positioning sensor, said first and second crank positioning sensors offset from one another and arranged to sense the rotation of a rotating member comprising a plurality of elements thereon with at least one reference element, wherein said first crank positioning sensor and said second crank positioning sensor produce high signals corresponding passage of said elements, low signals corresponding to passage of the space between said elements, and a reference signal corresponding to said at least one reference element, said signal processor comprising a first processing module configured to process information from said first crank positioning sensor, thereby generating a processed first crank positioning signal series; and a second processing module configured to process information from said second crank angle sensor so as to create a reference signal corresponding to a reference signal from said first crank angle sensor; or, in place of a reference signal from said second crank angle sensor, creating an element signal corresponding to an element signal from said first crank positioning sensor, thereby generating a processed second crank angle signal series that resembles said processed first crank positioning signal series.

15. The signal processor of claim 14, further comprising circuitry to generate an output signal based on at least one of said processed first crank positioning signal series and said processed second crank positioning signal series.

16. The signal processor of claim 15, wherein said output signal is based on a combination of said processed first crank positioning signal series and said processed second crank positioning signal series when both said first crank positioning sensor and said second crank positioning sensor are operating.

17. The signal processor of claim 15, wherein said output signal is based on said processed first crank positioning signal series if said first crank positioning sensor is operating and said second crank positioning sensor is not operating; and wherein said output signal is based on said second processed crank positioning signal series if said second crank positioning sensor is operating and said first crank positioning sensor is not operating.

18. The signal processor of claim 14, wherein said at least one reference element corresponds to at least one missing element on said rotating member.

19. A method of processing a series of signals from a crank positioning sensor, said series of signals comprising a plurality of digital high signals, a plurality of digital low signals and at least one missing signal, said method comprising counting the number of high signals occurring between two successive reference signals, wherein when a predefined number of high signals occurring is counted, said series of signals is designated to be synchronized; after said series of signals is synchronized, converting at least one high signal to a low signal at a predetermined location and creating a high signal in place of said at least one missing signal.

20. The method of claim 19, wherein eighty-eight high signals are counted after said at least one missing signal, with first high signal after said at least one missing signal being counted as zero, converting the eighty-sixth high signal into a low signal.

21. The method of claim 19, wherein fifty-seven high signals are counted after said at least one missing signal, with first high signal after said at least one missing signal being counted as zero, converting the fifty-sixth high signal into a low signal.

22. An engine control system for an internal combustion engine, wherein said engine comprises at least one cylinder, each cylinder retaining a piston, and wherein a crankshaft is operationally coupled to the pistons such that the crankshaft rotates twice per engine cycle and the position of each piston depends upon the rotational position of the crankshaft, said engine control system comprising:

(a) a signal processor, wherein said signal processor is configured to receive signals from two or more crank positioning sensors;

(b) a rotating member arranged to rotate in direct correlation with said crankshaft, said rotating member comprising a plurality of equidistantly spaced elements with at least one reference element;

(c) a first sensor mounted proximate to said rotating member to sense the passage of said equally spaced elements, wherein said first sensor is communicatingly connected to said signal processor;

(d) a second sensor mounted proximate to said rotating member to sense the passage of said equally spaced elements, wherein said second sensor is communicatingly connected to said signal processor;

wherein said signal processor comprises a first processing module and a second processing module to receive and process said output signals from said first sensor and said output signals from said second sensor, respectively, said first and second processing modules configured to produce an active crank signal stream, said active crank signal stream persisting despite failure of either first sensor or second sensor, without needing to switchover receiving signals from one sensor to another.

23. The engine control system of claim 22, wherein said at least one reference element corresponds to at least one missing element on said rotating member.

24. A computer program product for use with a locomotive engine, said product comprising:

a computer-usable medium comprising computer readable program code modules embodied in said computer-usable medium for manipulating signals from a first and second crank positioning sensors, said first and second crank positioning sensors generating a series of digital high signals, a series of digital low signals and at least one reference signal;

computer readable first program code module for causing a computer to count the number of high signals occurring between two successive reference signals;

computer-readable second program code module for causing said computer to convert at least one high signal from said first or second crank positioning sensors into a reference signal at a predetermined location on said series of high signals;

computer-readable third program code module for causing said computer to create at least one high signal in place of said at least one reference signal from said first or second crank positioning sensors.

25. The computer program product of claim 24, wherein said computer-readable second program code module causes said computer to convert at least one high signal from said second crank positioning sensor into a reference signal coincidental with a reference signal from said first crank positioning sensor.

26. The computer program product of claim 25, wherein said computer-readable third program module causes said computer to create at least one high signal from said second crank positioning sensor in place of a reference signal from said second crank positioning sensor.

27. A computer program product for use with a locomotive engine, said product comprising:

a computer-usable medium comprising computer readable program code modules embodied in said computer-usable medium for generating a continuous stream of signals useful for determining crankshaft position, said continuous stream of signals derived from a first series of signals from a first crank positioning sensor and a second series of signals from a second crank positioning sensor, said method comprising:

a computer-readable first program code module for causing a computer to modulate said second series of signals to produce a modulated series of signals that resembles said first series of signals, thereby producing two series of signals that resemble each other; and a computer-readable second program code module for causing a computer to generate a signal stream based on (i) a combination of said first series of signals and said modulated series of signals if both of said first and second crank positioning sensors are operating, (ii) said first series of signals if said first crank positioning sensor is operating and said second crank positioning sensor is not operating, and (iii) said modulated series of signals if said second crank positioning sensor is operating and said first crank positioning sensor is not operating wherein a continuous stream of signals is generated that persists even in the event of operational failure of one of said first and second crank positioning sensors.

* * * * *